US006198373B1

(12) United States Patent
Ogawa et al.

(10) Patent No.: US 6,198,373 B1
(45) Date of Patent: Mar. 6, 2001

(54) WIRE WOUND ELECTRONIC COMPONENT

(75) Inventors: Hideki Ogawa, Takasaki; Hideo Aoba, Maebashi; Yoshihiro Amada, Tamamura-machi; Takayuki Uehara, Yoshii-machi; Kazuhiko Otsuka, Gunma-machi; Hideyuki Karasawa, Maebashi; Nobuyasu Shiba, Yoshii-machi, all of (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/131,392

(22) Filed: Aug. 7, 1998

(30) Foreign Application Priority Data

Aug. 19, 1997 (JP) ..... 9-237687
Aug. 19, 1997 (JP) ..... 9-237688
Aug. 19, 1997 (JP) ..... 9-237690

(51) Int. Cl.[7] ..... H01F 27/02
(52) U.S. Cl. ..... 336/83; 336/90; 336/96
(58) Field of Search ..... 336/96, 83, 90, 336/58, 94, 200; 29/602.1

(56) References Cited

U.S. PATENT DOCUMENTS

| | | | | |
|---|---|---|---|---|
| 3,308,414 | * | 3/1967 | Ostrander et al. | 336/96 |
| 3,628,986 | * | 12/1971 | Segura | 428/127 |
| 4,555,422 | | 11/1985 | Nakamura et al. . | |
| 4,717,901 | | 1/1988 | Autenrieth et al. . | |
| 5,189,080 | | 2/1993 | Heyke et al. . | |

FOREIGN PATENT DOCUMENTS

| | | | | |
|---|---|---|---|---|
| 1007 529 | | 9/1962 | (DE) . | |
| 242817 | | 11/1985 | (DE) . | |
| 0234085 A1 | | 7/1986 | (EP) . | |
| 0307157 A2 | | 9/1988 | (EP) . | |
| 0375851 | | 3/1989 | (EP) . | |
| 0650242A1 | | 7/1994 | (EP) . | |
| 2013040 | | 1/1979 | (GB) . | |
| 2044550 | | 2/1980 | (GB) . | |
| 2037087 | * | 7/1980 | (GB) | 336/96 |
| 2220945 | | 7/1989 | (GB) . | |
| 2246124 | | 4/1991 | (GB) . | |
| 61-77625 | | 9/1984 | (JP) . | |
| 61-113642 | | 5/1986 | (JP) . | |
| 199413 | | 2/1988 | (JP) . | |
| 63-236305 | | 10/1988 | (JP) . | |
| 199412 | | 8/1989 | (JP) . | |
| 40338613 | | 5/1991 | (JP) . | |
| 6204023 | | 12/1992 | (JP) . | |

OTHER PUBLICATIONS

"Patents Abstracts of Japan" vol. 13, No. 496 (E–843), (3844) Jan. 9, 1989, The Patent Office Japanese Government.

* cited by examiner

*Primary Examiner*—Lincoln Donovan
*Assistant Examiner*—Tuyen Nguyen
(74) *Attorney, Agent, or Firm*—McDermott, Will & Emery

(57) ABSTRACT

The present invention is to provide a wire wound electronic component with stable quality, as well as raising reliability thereof by improving heat radiation, water-proofness, resistance against static electricity, resistance against stresses, magnetic characteristic thereof.

Powder of one or both of an inorganic material and a metallic material having higher thermal conductivity than a resin is added as a filler in the above resin, or a mixture of one or both of powders of the said inorganic material or the said metallic material and powders of a ferrite material for magnetic shielding is added as a filler in the above resin. When a sealing resin comprising a high thermal conductive material added thereto is used, heat generated inside a wire wound electronic component by passing a current through a coil conductor is effectively released outside the component, and the component can have a good heat radiation. Especially when the metallic powder is used as an additive, static electricity is prevented from being charged and generation of static electricity is also restrained.

1 Claim, 14 Drawing Sheets

FIG. 1(A)

| | |
|---|---|
| Powder of high thermal conductive inorganic material | 90wt% |
| + | |
| Resin material | 10wt% |

FIG. 1(B)

| | |
|---|---|
| Metallic powder | 90wt% |
| + | |
| Resin material | 10wt% |

FIG. 1(C)

| | |
|---|---|
| Powder of high thermal conductive inorganic material | 80wt% |
| + | |
| Metallic powder | 10wt% |
| + | |
| Resin material | 10wt% |

FIG. 1(D)

| | |
|---|---|
| Powder of high thermal conductive inorganic material | 20wt% |
| + | |
| Ferrite powder for magnetic shield | 70wt% |
| + | |
| Resin material | 10wt% |

FIG. 1(E)

| | |
|---|---|
| Metallic powder | 20wt% |
| + | |
| Ferrite powder for magnetic shield | 70wt% |
| + | |
| Resin material | 10wt% |

FIG. 1(F)

| | |
|---|---|
| Powder of high thermal conductive inorganic material | 10wt% |
| + | |
| Metallic powder | 10wt% |
| + | |
| Ferrite powder for magnetic shield | 70wt% |
| + | |
| Resin material | 10wt% |

WIRE WOUND ELECTRONIC COMPONENT

FIELD OF THE ART

The present invention relates to an inductor, transformer, choke coil, common mode choke coil or similar wire wound electronic component.

BACKGROUND ART

A wire wound electronic component has a structure as shown in FIG. 14(A). In this FIG. 14(A), at both ends of the core 10, whereon a wire is wound and whose shape is a column having a circle (oval, rectangular or similar shape) cross-section, has flanges 12 and 14 having a prism shape (or a plank shape with a rectangular cross-section) are formed. The core 10 and the flanges 12 and 14, all of which are made of magnetic materials, e.g., ferrite, form a coil bobbin 16. Electrodes 18 and 20 are formed on each side and end surfaces of the flanges 12 and 14 respectively.

The conductor 22 is wound on the core 10 formed at the central portion of the coil bobbin 16. The lead wires 24 and 26 at both ends of the conductor 22 are connected to the electrodes 18 and 20 respectively at each of side surfaces of the flanges 12 and 14. A concave portion formed between flanges 12 and 14 is coated with a sealing resin 28 to cover the conductor 22. The electrodes 18 and 20 whereto the lead wires 24 and 26 are respectively connected are applied with plates 30 and 32 respectively.

The above sealing resin 28 is made of, e.g., epoxy resin wherein ferrite powder is mixed as disclosed in Japanese Patent Laid-Open Publication No. 63-236305. Main components of the ferrite powder to be used for this purpose are, e.g., iron oxide, nickel oxide, zinc oxide, and copper oxide. Addition of the ferrite powder improves the magnetic shielding effect of the sealing resin 28 as shown by the dotted lines in FIG. 14, because it will allow a magnetic flux 34 to easily pass through inside the sealing resin 28. It will also enable to reduce magnetic effects exerted on the adjacent components, and improve the inductance of a wire wound electronic component.

When an electric current is passed through the conductor 22 of a wire wound electronic component having a structure described above, it generates heat. Ferrite used in the coil bobbin 16 and ferrite powder used as a filler for the sealing resin 28 changes the magnetic permeability ($\mu$) thereof which shows the magnetic characteristics, along with its thermal changes. Accordingly, similar to other ordinary electronic components, it requires good thermal radiation. In terms of mounting, it requires a good countermeasure to prevent generation of static electricity for preventing the components from sticking to each other.

In addition, when there is not a close contact between the coil bobbin 16 and the sealing resin 28, as shown by the arrow FA in FIG. 14, water will enter into cracks of the component from the joint portion of the flange 12 (or 14) with the sealing resin 28, thereby reliability of the component will be deteriorated. The cracks will also cut the current of the magnetic flux 34 at the above joint portion, thereby the magnetic shielding effect and inductance will be lowered. If there is a pinhole 36 in the sealing resin 28, water will also enter inside the component as shown by the arrow FB.

If ferrite content is raised to increase the inductance, fine ferrite powder particles 38 may be strung from the surface of the sealing resin 28 to the coil bobbin 16 or the conductor 22. In this case, water might also enter into the component along with the surface of the strung fine ferrite powder particles 38 as shown by the arrow FC. The same thing might happen when the surface of the fine ferrite powder particles 38 do not have wettability towards the resin materials.

Ferrite powders filled into the sealing resin 28 are made by burning generally at high temperature over 1000° C. Accordingly, the sintered ferrite substance becomes hard due to strong cohesion between the particles, and the size of the ferrite powder particles made by pulverization of the above ferrite substance might easily be varied. When those ferrite powder particles with uneven sizes are mixed into the above mentioned sealing resin for using an wire wound electronic component, it will suffer from several problems, i.e., deterioration of applicability of the sealing resin, unstable magnetic characteristic in the portion of the sealing resin, or similar problem. In other words, this would change the magnetic permeability in the portion of the sealing resin, thereby each component inductance would be changed. In addition, because a high internal stress will change inductance along with the change of magnetic permeability of the coil bobbin, as well as it would cause a damage of the coil bobbin, a break of the conductor or similar problem, relaxation of the internal stress might be desirable.

Filling ferrite powder into the resin will raise the viscosity of a sealing resin as a whole. When a sealing resin of high viscosity is used for coating and forming, the sealing resin will have less applicability than a sealing resin of low viscosity, and it will also requires high forming pressure. This high forming pressure accordingly exerts large stress on the coil bobbin 16 and conductor 22. This might cause a crack at, e.g., the joint portion of the flanges 12 and 14 with the core 10 because the portion is more vulnerable, or might cause a break of the conductor 22.

In addition, changes of stress will change the inductance. On one hand, this may cause deterioration of the component quality due to uneven quality, on the other hand, this may cause less manufacturing efficiency to produce the components with even quality.

The present invention, paying attention to the points stated above, has objectives to improve the thermal radiation, resistance against water and static electricity, and have better reliability of a wire wound electronic component.

Another objective is to obtain a sealing resin with stable magnetic characteristics and low internal stress by controlling the size of ferrite powder particles as a filler, as well as to retain good magnetic shielding effect.

In addition, another objective is to have efficient productivity of a wire wound electronic component with good quality by controlling change of inductance attributed to change of stress, as well as to protect a coil bobbin and wire by relieving stresses.

DISCLOSURE OF THE INVENTION

The present invention is characterized by addition of powder of high thermal conductive material into the above resin in a wire wound electronic component whose conductor wound on the coil bobbin is sealed with a resin material. Another configuration of the present invention comprising a wire wound electronic component whose conductor wound on the coil bobbin is sealed with a resin material including additives is characterized by hydrophobic surface treatment which coats the above additives. Another configuration of the present invention comprising a wire wound electronic component whose conductor is sealed with a sealing resin is characterized by a multi-layer structure of the above resin comprising an ordinary resin and a ferrite-mixed resin. In addition, another configuration of the present invention is characterized by relaxation material added to at least one of a coil bobbin and a sealing resin.

A method of producing a wire wound electronic component of the present invention is characterized by comprising the steps of winding a conductor around a coil bobbin; applying a thermosetting resin or a thermoplastic resin on the coil bobbin after the wire-winding step; application of heat and vibration to a block after application of the resin and placing thereof into magnetic powders. A filler to the sealing resin for a wire wound electronic component of the present invention is characterized by being produced by pulverizing the mixture whose main ingredients are $Fe_2O_3$, NiO, ZnO, CuO after burning thereof.

Many other features, advantages and additional objects of the present invention will become manifest to those versed in the art upon making reference to the detailed description which follows and the accompanying sheet of drawings.

BRIEF DESCRIPTION OF THE DRAWINGS

FIGS. 1(A)–(F) show states of additives in the embodiment 1 of the present invention.

BEST MODE OF PRACTICING THE INVENTION

While the present invention is practicable in various modes, an adequate number of embodiments thereof will be shown and described in detail.

(1) Embodiment 1

Embodiment 1 of the present invention is to improve reliability of a wire wound electronic component by cutting back generation of static electricity as well as to improve thermal conductivity thereof as shown in FIG. 1. The composition thereof is either of the following:

a, Powder of either one or both of an inorganic material or a metallic material which are more thermal conductive than a resin is added to the resin as filler. (See FIGS. 1(A)–(C)), b, Mixture of powder of either or both of the above inorganic material or metallic material, and ferrite powder for magnetic shielding is added to the resin as filler. (See FIGS. 1(D)–(F)).

Using a sealing resin wherein the above mentioned high thermal conductive materials are added will allow a wire wound component to have a better heat radiation because heat generated inside the component by passing a current will be effectively released outside the component through the high thermal conductive material. Especially when metallic powder is used as an additive to the resin, it also prevents from bearing electrical charges and restrains generation of static electricity. This will also allow an improved mounting of components because the components will no longer adhere to each other upon installing. Some of the high thermal conductive materials mixed into the resin could change magnetic permeability of the sealing resin, which will finally change inductance of the component. Accordingly, controlling the mixture ratio of high thermal conductive materials will allow inductance of the component to be desirably adjusted.

Next, in an example of the embodiment 1, thermosetting resin, thermoplastic resin or similar materials are used as a resin. Epoxy resin is a favorable material. For inorganic materials with high thermal conductivity, ferrite, aluminum nitride, diamond or similar material are used. Because metallic materials are, in general, highly thermal conductive, all of them are applicable for the purpose.

Figure 10A:
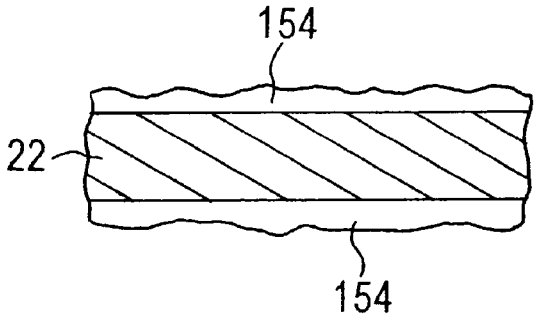
FIGS. 10(A)–(C) show vertical sections of the component provided in a main manufacturing process of the embodiment 10 of the present invention.
Figure 10B:
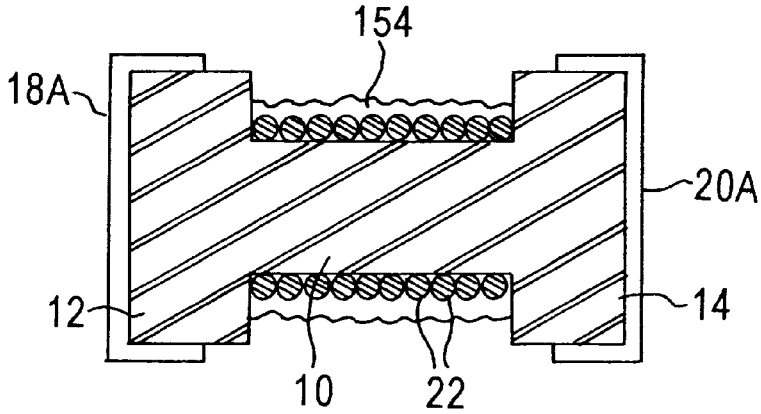
Figure 10C:
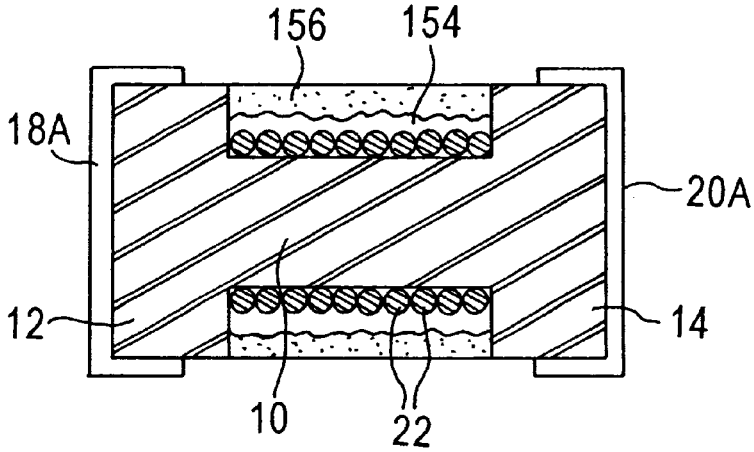

For example in FIG. 1(A), 10 wt % of resin is mixed with 90 wt % of high thermal conductive inorganic material. The reason for giving the above mixture ratio is that though mixing as large ratio of high thermal conductive inorganic material as possible is more effective, the resin will have less reinforcing effect along with raise of the mixture ratio of high thermal conductive material. Given those conditions, at least 10 wt % of resin needs to be mixed. FIGS. 1(B)–(F) shows examples of weight mixture ratio of the materials.

In terms of particle size of the high thermal conductive material, too small-sized particle does not contribute to improvement of thermal conductivity. On the contrary, too large-sized particle might deteriorate applicability of the resin, make the surface of the sealing resin uneven, or cause uneven quality. Taken these conditions into account, in FIG. 1(A), for example, appropriate particle size may range from 1 to 100 $\mu$m, and an appropriate average size of particles may be 10 $\mu$m. The same thing can be said for FIGS. 1(B)–(F).

In addition, in the cases of FIGS. 1(D)–(F), a ferrite material for magnetic shielding is filled into the sealing resin. Mixture ratio and particle size of the ferrite and the high thermal conductive material should be decided by the balance between magnetic shielding effect provided by the ferrite and heat radiation effect provided by the high thermal conductive material (which contributes to improving reliability). Especially when the ferrite is used as a high thermal conductive inorganic material, if particle size distribution ranges 1 to 100 $\mu$m, fine-grained particles will move and the internal stress of the component will be released when the mixed sealing resin is hardening.

(2) Embodiment 2

Figure 14A:
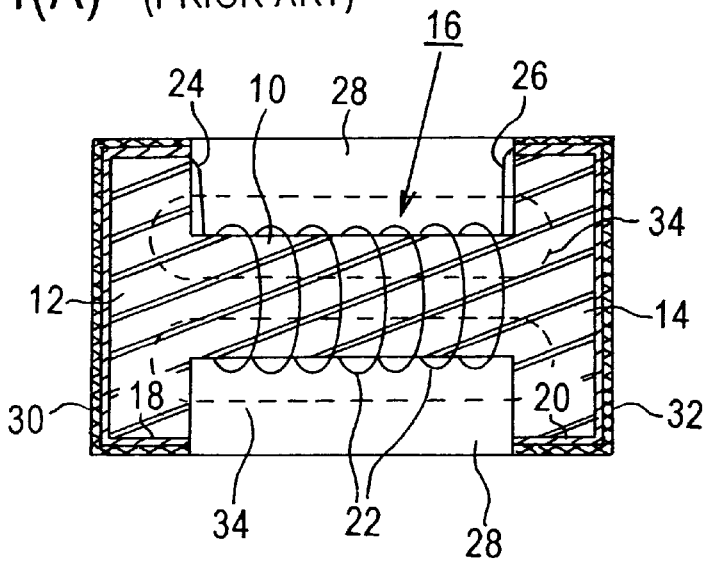
FIG. 14(A) (PRIOR ART)
FIGS. 14(A)–(B) show a basic structure of an example of a wire wound electronic component and a state of a portion of the sealing resin thereof.
Figure 14B:
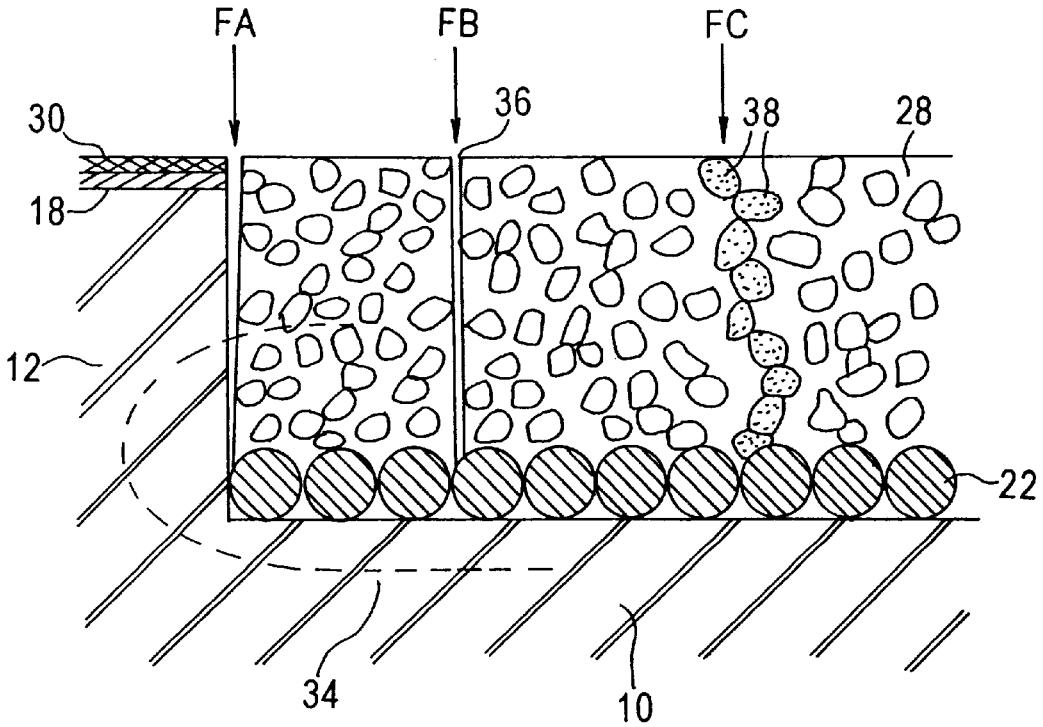
FIG. 14(B) (PRIOR ART)

The embodiment 2 is an improved mode of the background art to have better reliability in terms of keeping close contact of the coil bobbin with the sealing resin. As shown by the arrow FA in FIG. 14(B), if the coil bobbin 16 does not keep close contact with the sealing resin 28, water may enter into the component from the crack between them, which will end up with deteriorating the water-proofness thereof. In the embodiment 2, the thermal expansion coefficient (or the thermal expansion modulus) of the sealing resin is adjusted by increasing or decreasing of the amount of the ferrite powder for magnetic shielding, or by adopting an appropriate shape of the ferrite powder. By doing so, when the thermal expansion coefficient of the sealing resin 28 comes close to that of the ferrite material comprising the coil bobbin 16, exfoliation of the sealing resin caused by, e.g., thermal changes will be prevented. Accordingly, entry of water from the joint portion of the flange 12 and 14, and the sealing resin 28 will be prevented because the sealing resin 28 will have closer contact with the coil bobbin 16.

In an practical example of the embodiment 2, an appropriate mixture ratio of ferrite powder and a resin is, e.g. 70 wt % and 30 wt %. In addition, a favorable size of ferrite particle might be 1 to 100 $\mu$m. Using ball-shaped ferrite powder will also enable to adjust thermal expansion coefficient because thereby ferrite powder is allowed to have a wider dispersion.

(3) Embodiment 3

Figure 2:
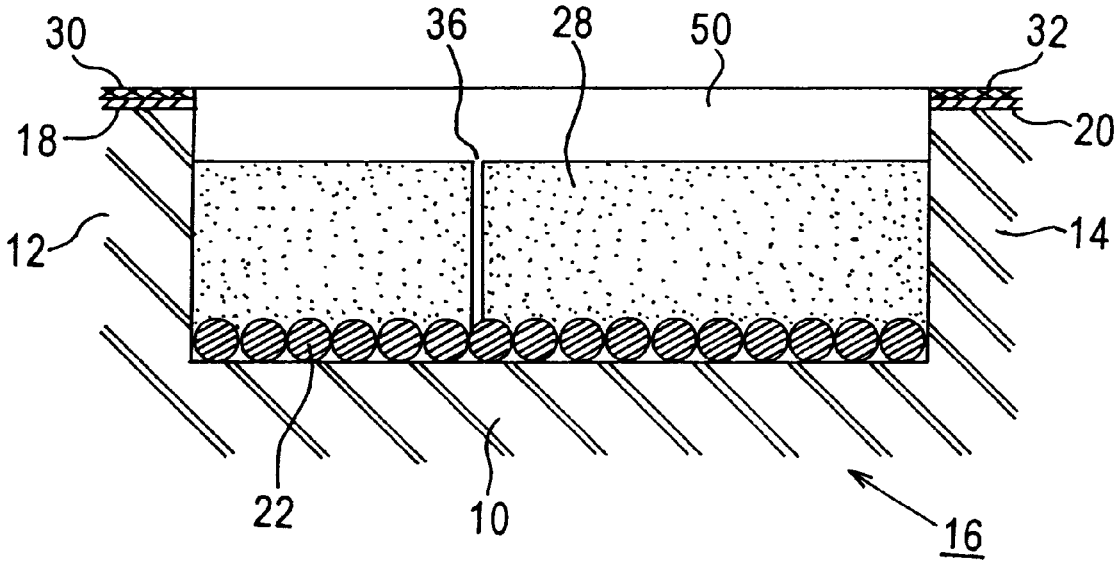
FIG. 2 shows a state of a portion of the sealing resin in the embodiment 3 of the present invention.

The embodiment 3 is an improved mode of the background art to prevent deterioration of water-proofness of the sealing resin caused by pinholes. As shown by the arrow FB in FIG. 14(B), if there is a pinhole 36 in the sealing resin 28, wherefrom water may enter into the component. As shown in FIG. 2, in the embodiment 3, the sealing resin has a resin layer 50 impregnated and coated thereon. By doing so, caulking the pinhole 36 of the sealing resin 28 with the resin layer 50 will prevent water from entering into the component and improve the water-proofness thereof. A favorable material for the resin layer 50 may be a material of low viscosity and high fluidity. The embodiment 3 will also improve formability of the surface of the sealing resin.

(4) Embodiment 4

The embodiment 4 is an improved mode of the background art to prevent deterioration of water-proofness of the sealing resin by mixing appropriate additives thereto. As shown by the arrow FC in FIG. 14(B), if ferrite powder particles 38 are strung out or the surface of the ferrite powder particles 38 does not have wettability towards the resin, water-proofness of the sealing resin will be deteriorated.

Figure 3:
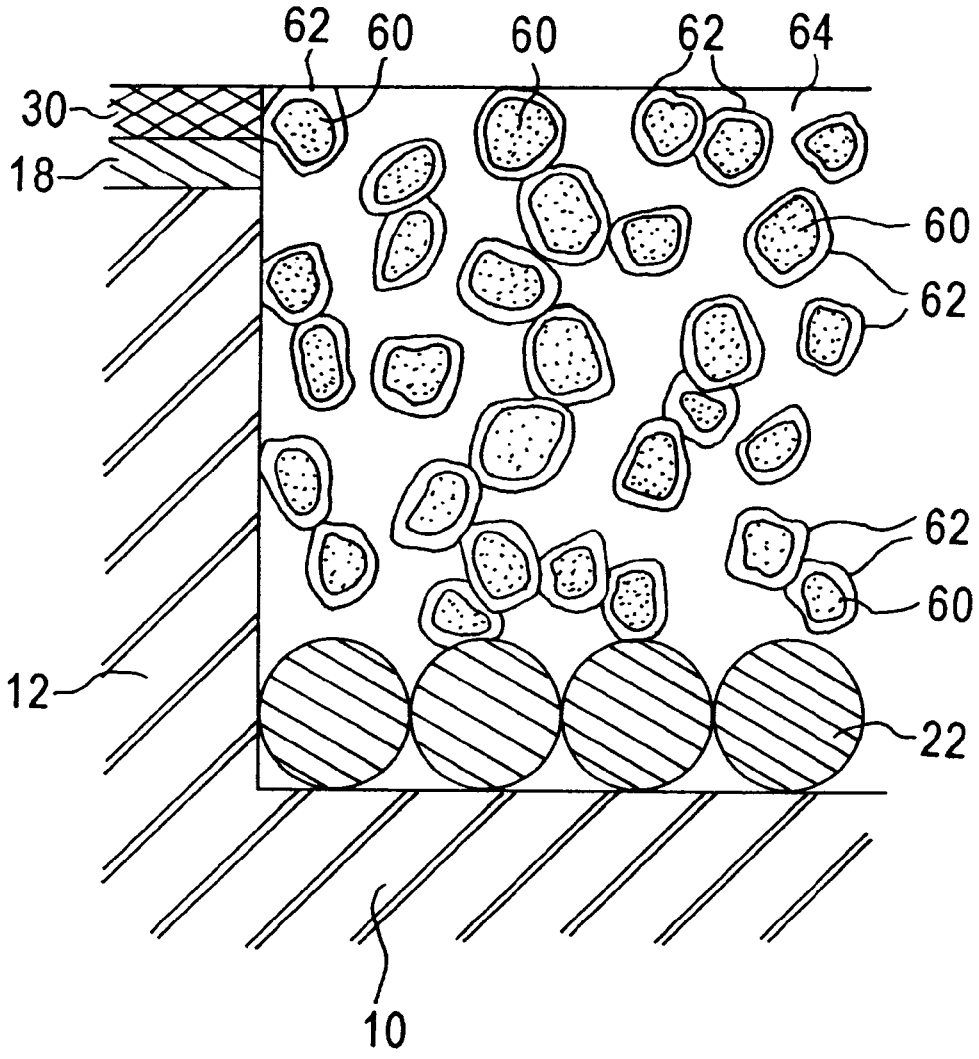
FIG. 3 shows a state of a portion of the sealing resin in the embodiment 4 of the present invention.

In the embodiment 4, as described in FIG. 3, a hydrophobic film 62 is formed on each of the surfaces of additives 60, i.e. a ferrite for magnetic shielding or a high thermal conductive material, by treating thereof with hydrophobe (micro-encapsulation). If the mixture ratio of ferrite to the sealing resin is increased, additives 60 will be strung out from the surface of a resin 64 to the coil bobbin 16 or the conductor 22 as described in FIG. 3. The embodiment 4, however, prevents the entry of water by the effect of the hydrophobic film 62 as shown by the arrow FC in FIG. 14(B), and is allowed to improve water-proofness thereof.

In addition, if the hydrophobic film 62 having a good wettability towards the resin 64 is used in the embodiment 4, the hydrophobic film 62 and the resin 64 keep closer contact at their interface, thereby water-proofness and hydrophobicity thereof are improved. If ferrite powder without surface treatment is used as a filler, it is desirable that the ferrite powder should have good wettability towards the resin.

In an example of the embodiment 4, specific methods of surface treatment for providing hydrophobicity to the additives 60 may include, e.g. a hydrophobic treatment with the use of fluoride surfactant agent or siliconized surfactant agent. Specific methods to improve wettability of the additives 60 towards the resin may include, e.g. silane coupling treatment or titan coupling treatment.

(5) Embodiment 5

Figure 4A:
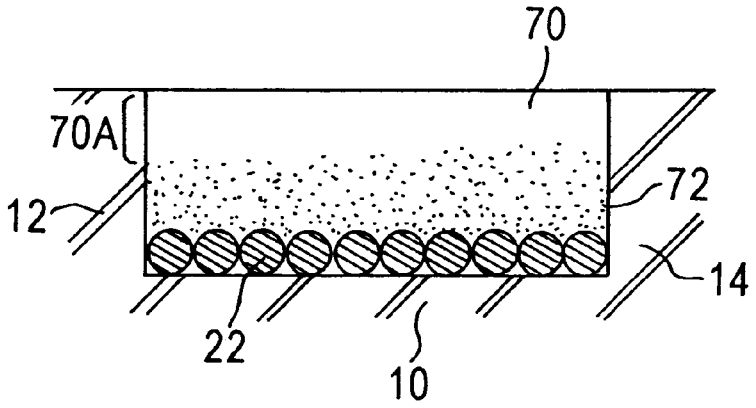
FIGS. 4(A)–4(C) show states of a portion of the sealing resin in the embodiment 5 of the present invention.

Similar to the foregoing embodiment, the embodiment 5 is also an improved mode of the background art to provide a better reliability thereof in terms of water-proofness and hydrophobicity. FIG. 4 shows states of a sealing resin in the embodiment 5. In FIG. 4(A), when the sealing resin 70 is coated and hardening, only the resin portion is selectively positioned on the interface with the surface, i.e. the outside air. This is made possible by applying centrifugal force or external magnetic field when the sealing resin is hardening, to shift additives 72 towards the conductor 22, and a resin layer 70A results in comprising the surface part. Using a resin with relatively low viscosity and high fluidity is favorable. The entry of water into the component (See the arrow FC in FIG. 14) caused by addition of the above additives 72 will be desirably prevented by the resin layer 70A.

Figure 4B:
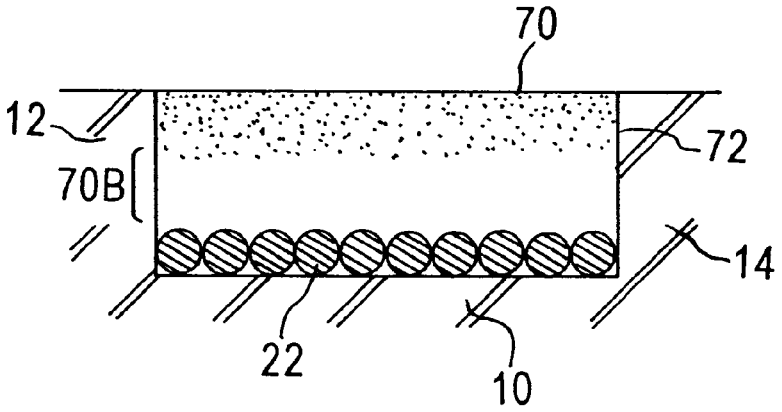
Figure 4C:
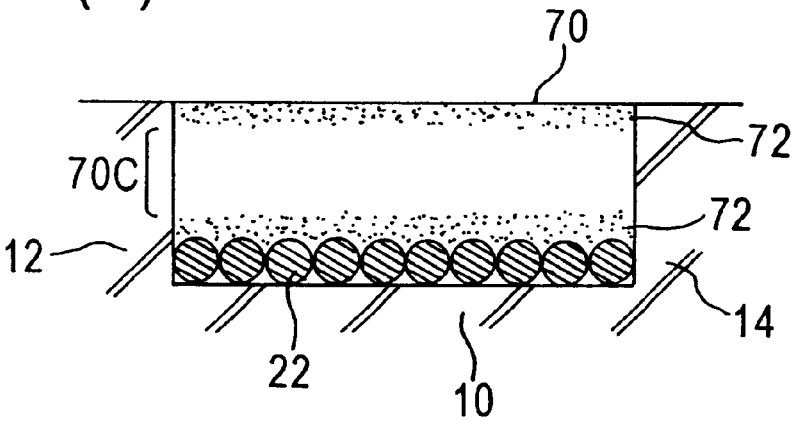

In FIG. 4(B), the additives 72 is shifted to the surface of the sealing resin 70, and a resin layer 70B is formed near the conductor 22. FIG. 4(C) is a combination of FIG. 4(A) and (B), wherein a resin layer 70C is formed in the center of the sealing resin 70. This structure is realized by, e.g. applying the foregoing centrifugal force or external magnetic field, and making the sealing resin 70 a multi-layer structure.

(6) Embodiment 6

Figure 5:
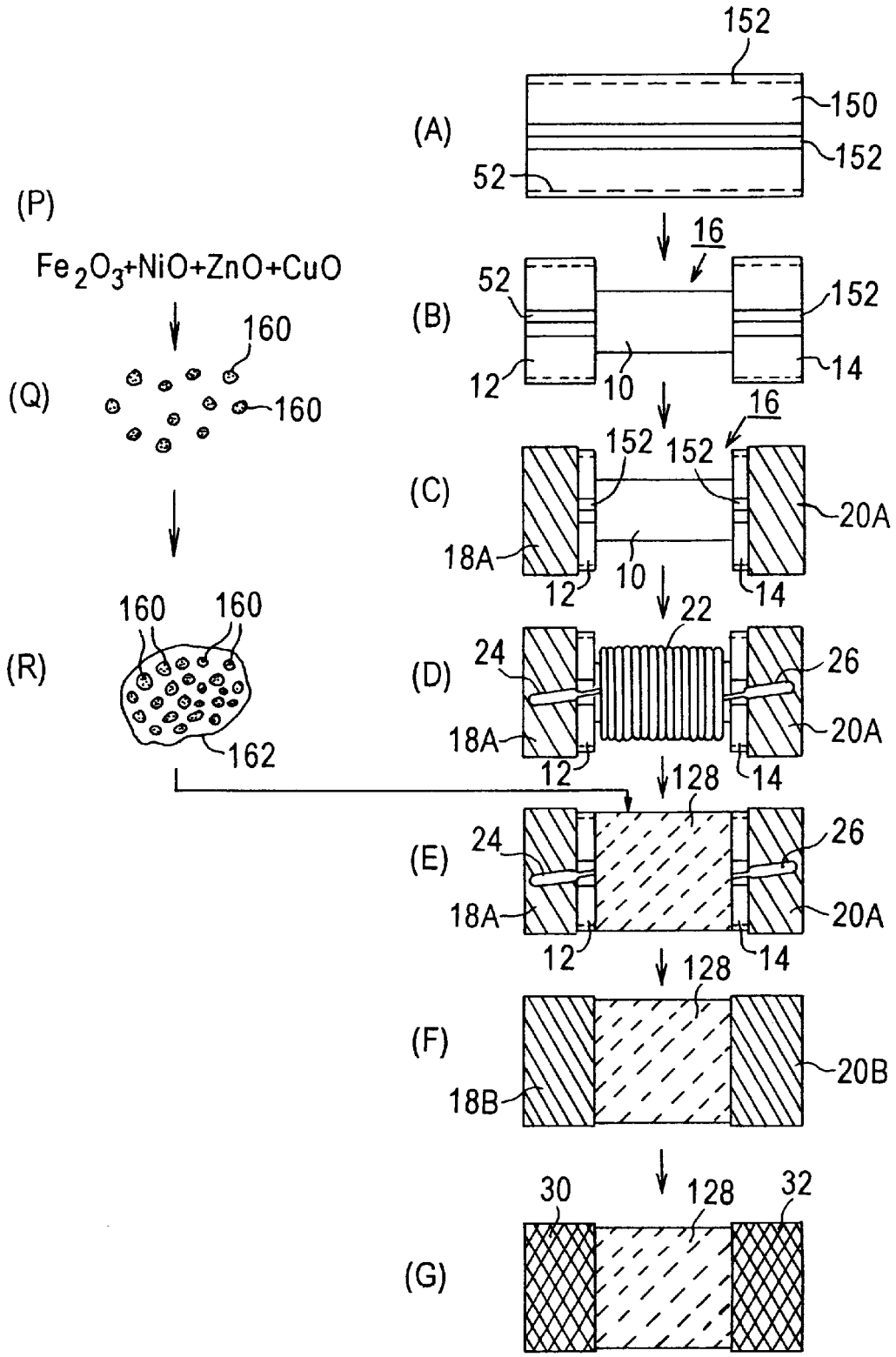
FIGS. 5(A)–(G) and 5(P)–(R) show a main manufacturing process of a wire wound electronic component in the embodiment 6 of the present invention.
Figure 6A:
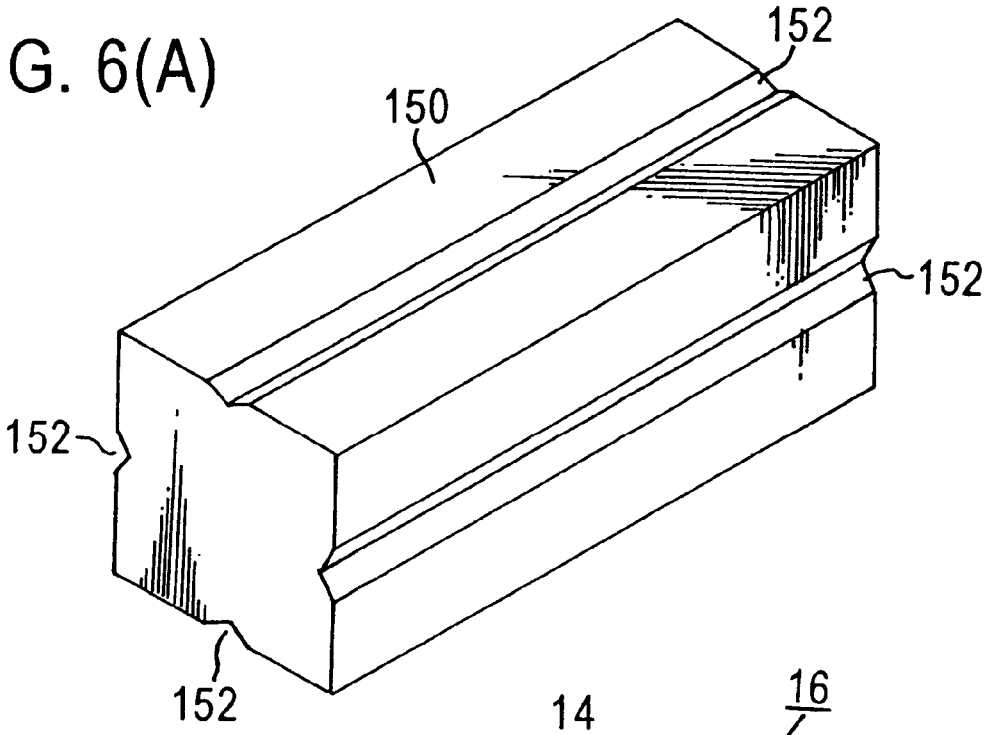
FIGS. 6(A)–(B) show shapes of a core block, a coil bobbin, and an inductance device.

Next, the embodiment 6 will be described. The embodiment 6 provides more stabilized magnetic characteristic of the sealing resin after mixing a ferrite therein by selecting appropriate components of a ferrite added to a resin. FIG. 5 shows a main manufacturing process of an inductance device in the embodiment 6. Firstly, a prism-shaped block 150 is to be prepared. The block 150 can be obtained by dry forming of, e.g. a ferrite. FIG. 6(A) shows a perspective view of the block 150, on each of the longer sides thereof a V-shaped (or U-shaped, concave-shaped) groove 152 is formed. The grooves 152, wherein a lead of the conductor is connected to an electrode, are to protect the joint portion of a lead of the conductor with an electrode.

Figure 6B:
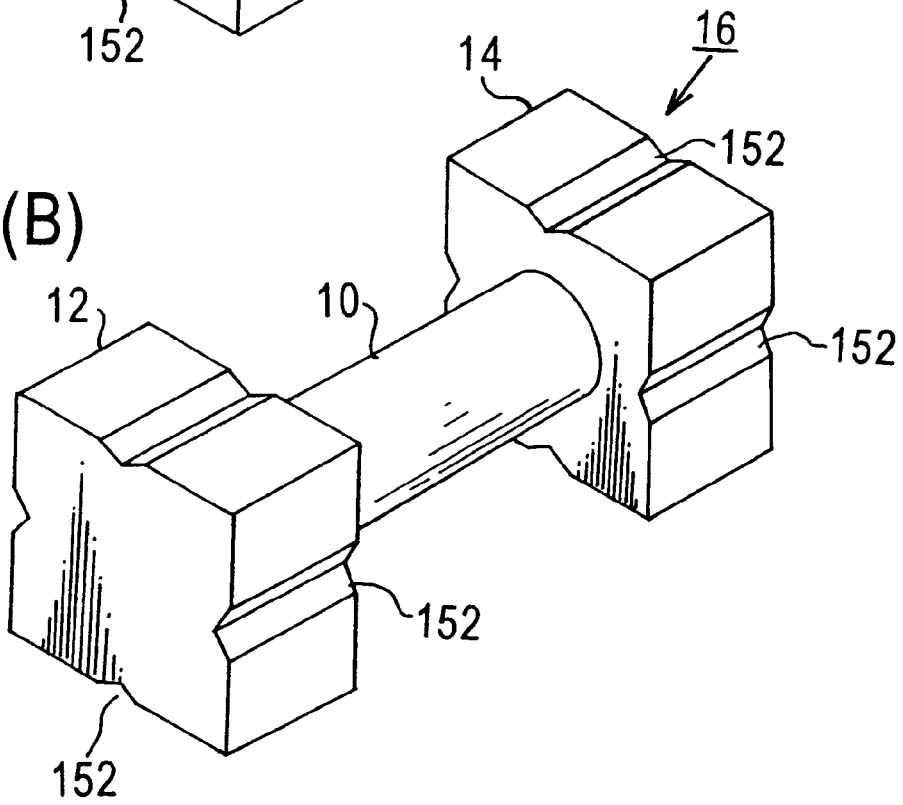

Secondly, as shown in FIG. 5(B), the core 10 and the flanges 12 and 14 are formed by grinding the central part of the block 150 into a column (or a column with oval cross-section, rectangular cross-section, or similar shaped cross-section). The coil bobbin 16 is obtained by burning the ground block 150. FIG. 6(B) shows a perspective view of the coil bobbin 16 produced through the above process. Then, as described in FIG. 5(C), the first layer electrodes 18A and 20A are formed respectively on sides and ends of flanges 12 and 14 by dipping or similar method. Following this, as shown in FIG. 5(D), the conductor 22 is wound around the core 10, and leads 24 and 26 are connected respectively to electrodes 18A and 20A in the grooves 152 formed on the flanges 12 and 14 by thermo-compression molding or the similar method.

Thirdly, as described in FIG. 5(E), a concave portion of the block formed between the flanges 12 and 14 is coated with the sealing resin 128 to seal the wound wire and form the resin shape. Generally, the entire block is formed so as to have a prism shape. Then, as shown in FIG. 5(F), the second layer of electrodes 18B and 20B are formed on the joint portion of the electrodes 18A and 20A respectively with leads 24 and 26, followed by application of plates 30 and 32 respectively thereon. An inductance device is produced through the above process. The second layer of electrodes 18B and 20B would be formed if appropriate, or they can be eliminated.

In the embodiment 6, as described in FIG. 5(P), a ferrite whose main ingredients are $Fe_2O_3$, NiO, ZnO, and CuO is used as a filler. Ferrite powder 160 is obtained by mixing, burning and pulverizing those ingredients as described in FIG. 5(Q), and the sealing resin 128 is obtained by mixing the ferrite powder 160 into, e.g. epoxy resin 162 as shown in FIG. 5(R). The sealing resin 128 is applied on a wire-wound portion of the block, as shown in FIG. 5(E).

Although a main ingredient of the ferrite -material is usually $Fe_2O_3$, NiO, ZnO and especially CuO are mixed therein in the embodiment 6. This allows burning temperature to be decreased than in usual cases. Lower burning temperature enables to make the pulverization easier, and makes sizes of the pulverized ferrite particle more even. Accordingly, after mixing of those ingredients, the sealing resin will show more even consistency and more stabilized magnetic characteristic. As the result, variations of the inductance can be reduced, so that a component with more consistent characteristics can be obtained.

Next, an example of the embodiment 6 will be explained. Firstly, ferrite powder obtained by pulverizing a compound made by mixing and burning $Fe_2O_3$, NiO, ZnO, and CuO is used as a ferrite filler. If size of ferrite powder particles is too small in doing so, the expected viscosity of the filler can not be obtained without increasing the amount of the resin, i.e., a bonding agent, because the surface area of the particles becomes too large. If the amount of the resin is increased, the amount of the ferrite filler may relatively be decreases, which would deteriorate magnetic permeability of the sealing resin and result in decrease of inductance of the component. To the contrary, if too large-sized ferrite powder particles are used, that may cause a rough surface of the sealing resin because the shape of the ferrite powder particles may appear on the surface thereof. It may also cause decrease of applicability of the sealing resin. Taking the above points into account, when distribution of the ferrite powder particles ranged 1 to 100 $\mu$m and the average size of the particles ranged 5 to 15 $\mu$m (10±5 $\mu$m), favorable results were obtained, and the sealing resin also indicated a good magnetic shielding effect.

From another standpoint, epoxy resin, e.g. a mixture of bisphenol A and an anhydrous hardening, is used as a resin. With using this resin, over 70 wt % of the ferrite powder and less than 30 wt % of the resin are mixed to obtain a sealing resin. When the sealing resin was used to manufacture an inductor device through the manufacturing process as shown in FIG. 5, inductance of the device was stabilized. The device also indicated a good magnetic shielding effect.

(7) Embodiment 7

Next, the embodiment 7 will be described. This embodiment is obtained by adding at least one of the additives, i.e. $Bi_2O_3$, $SiO_2$ and $Pb_3O_4$, when mixing the above $Fe_2O_3$, NiO, ZnO, and CuO to obtain a ferrite. Components of these additives, i.e. Bi, Si, and Pb, are among the particles of the main component, i.e. ferrite powder particles. Because of this, those components of the additives function as a buffer to absorb stresses exerted on the ferrite powder particles, and to allow the wire wound electronic component to easily resist against the outer stresses. In the way above mentioned, the ferrite filler has come to have the resistance against stresses, the sealing resin can prevent decrease of the inductance without deterioration of the magnetic permeability thereof. The characteristic of the device will also become stabilized because variations of inductance caused by internal stress inside the sealing resin or influence of forming pressure thereof are reduced.

In an example of the embodiment 7, 1 wt % of additives including at least one of the above, i.e. $Bi_2O_3$, $SiO_2$, and $Pb_3O_4$, is mixed with 99 wt % of the mixture of $Fe_2O_3$, NiO, ZnO, and CuO in order to obtain the ferrite powder. This ferrite powder is, then, mixed with a resin on the mixture ratio of 70 wt % to the resin. When an inductor device was manufactured through the manufacturing process as shown in FIG. 5 by using the sealing resin, the quality of the device became stabilized.

(8) Embodiment 8

Figure 7A:
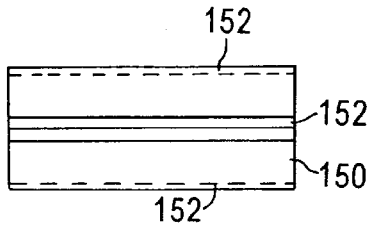
FIGS. 7(A)–(H) show a manufacturing process of the embodiment 8 of the present invention.
Figure 7B:
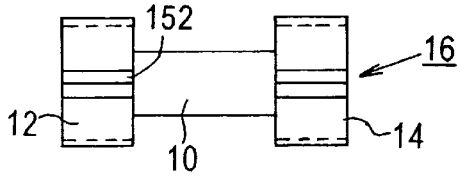
Figure 7C:
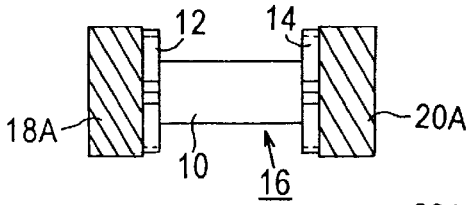
Figure 7D:
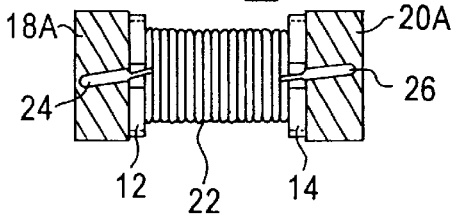
Figure 7E:
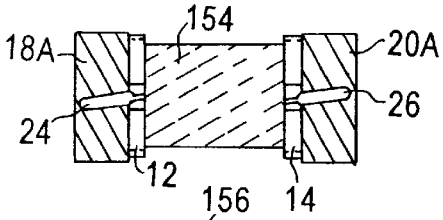
Figure 7F:
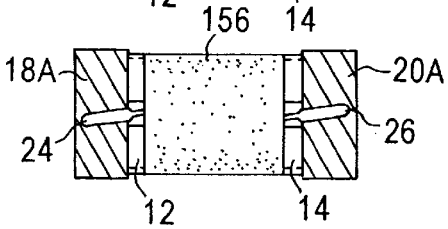
Figure 7G:
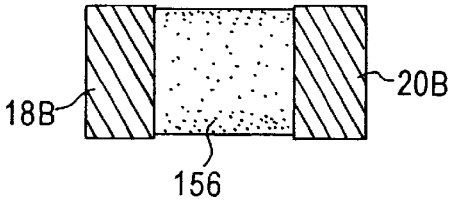
Figure 7H:
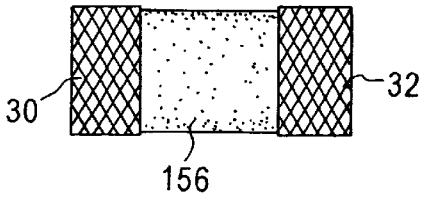
Figure 8A:
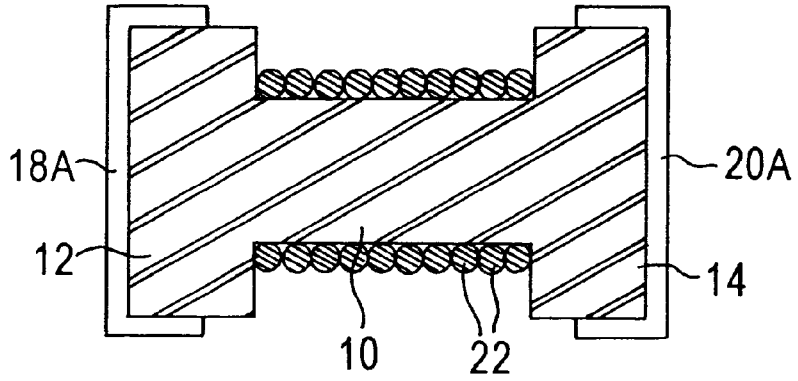
FIGS. 8(A)–(C) show vertical sections of the component provided in a main manufacturing process of the foregoing embodiment 8.
Figure 8B:
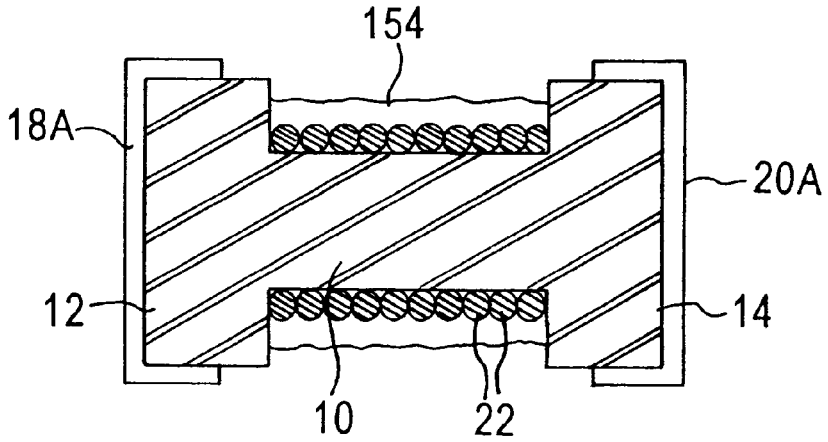
Figure 8C:
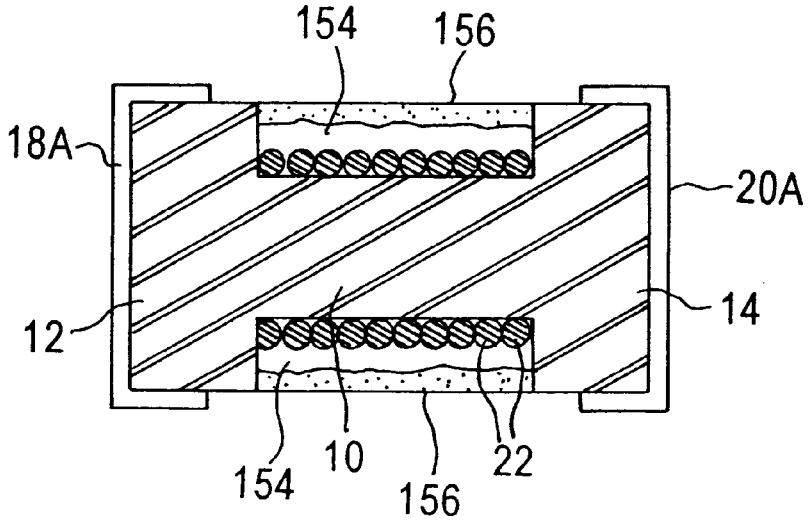

Referring to FIG. 7 and FIG. 8, the embodiment 8 will be explained. In this embodiment, resins filled without and with a ferrite are used. In FIG. 7, a main manufacturing process of an inductor device in the embodiment 8 is described. FIGS. 7(A)–(D) show the same as described in the foregoing embodiment 6. Next, as shown in FIG. 7(E), an ordinary resin 154 is applied on a concave portion of the block between the flanges 12 and 14 it is desirable that the coating resin used in this process should have a small linear expansivity and a small elastic coefficient. The ordinary resin means a resin wherein a ferrite is not filled, and resins below, e.g., epoxy resin, phenol resin, unsaturated polyester resin, silicone resin, polyimide resin, polyamide resin, polyurethane resin, polybutylene terephthalate resin, polyphenylene sulfide resin, polyphenylene ether resin, polyether ketone resin, liquid crystal polyester resin or similar can be used.

Next, as shown in FIG. 7(F), a ferrite-mixed resin 156 made up by mixing ferrite powder into the above resins. The ferrite-mixed resin 156 is formed and hardened along with the application thereof on the foregoing ordinary resin 154. In general, the entire block is formed into a prism shape, taking the mounting thereof into account. After the above coating, as shown in FIG. 7(G), the second layer of electrodes 18B and 20B are formed at the joint portion of the electrodes 18A and 20A with leads 24 and 26. Then, as described in FIG. 7(H), the plates 30 and 32 are applied onto the second layer of electrodes 18B and 20B respectively. As described above, an inductor device is manufactured. The second layer of electrodes 18B and 20B can be eliminated when appropriate.

FIGS. 8 (A)–(C) show vertical sections of the device in the main manufacturing process thereof. FIGS. 8 (A)–(C) correspond respectively to FIGS. 7 (D)–(F). As shown in these magnified drawings, the ordinary resin 154 is first applied onto a conductor 22, subsequently the ferrite-mixed resin 156 is applied. In the other word, the sealing resin has a two-layer structure comprising layers of the ordinary resin 154 and the ferrite-mixed resin 156.

As described above, the ordinary resin 154 is formed at the inner side of the block. That is, the device has a structure comprising of an inner layer made of a softer resin and an outer layer made of a harder resin. This two-layer structure allows the device to show a lower viscosity and a higher fluidity compared to the background art wherein only the ferrite-mixed resin is used. Accordingly, even if the ferrite-mixed resin 156 is applied as the most outer layer, stress will be relaxed by the ordinary resin 154, and there will be less number of cracks appearing in the coil bobbin 16, especially at the joint portion of the core 10 with the flanges 12 and 14. The structure also enables to relax the stresses exerted on the conductor 22 and prevent a break thereof. In addition, the structure also reduces the variations of inductance, and improves the reliability and productivity of the device. The tow-layer structure also prevents a thorough entry of water into the inner side of the device because a pinhole would never pass through from the surface to the inside thereof.

(9) Embodiment 9

Figure 9A:
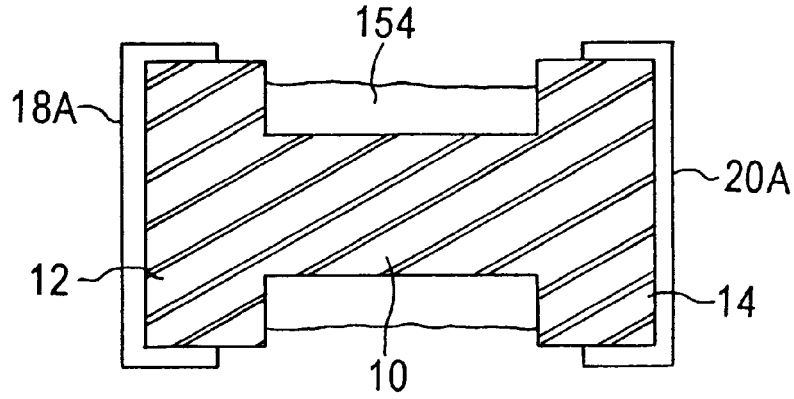
FIGS. 9(A)–(C) show vertical sections of the component provided in a main manufacturing process of the embodiment 9 of the present invention.
Figure 9B:
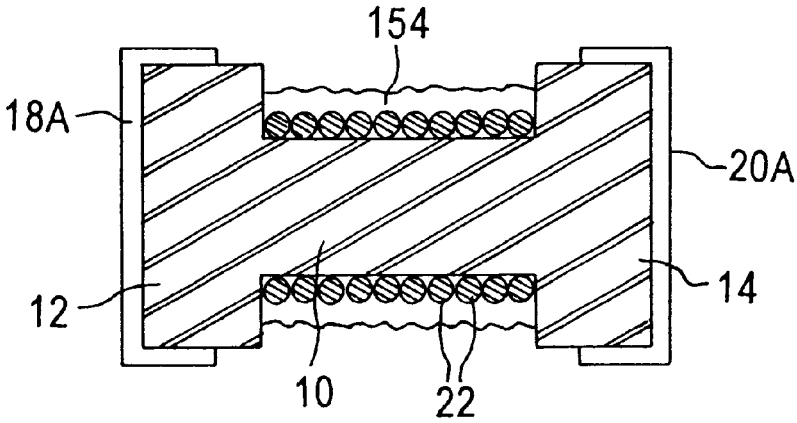
Figure 9C:
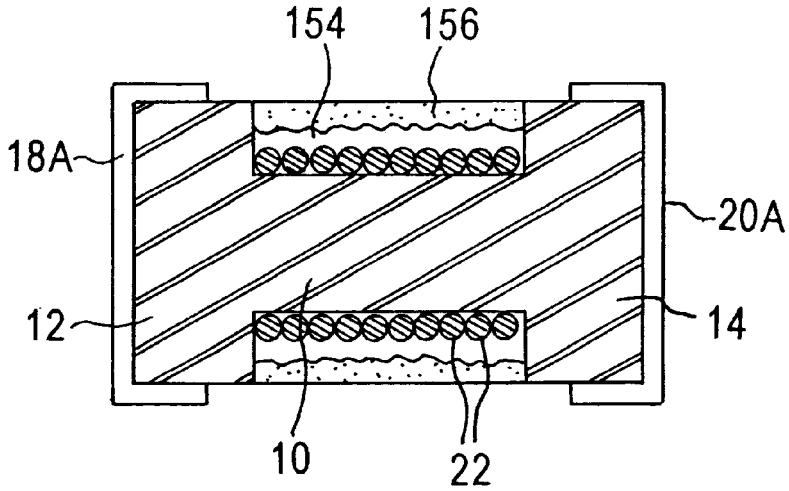

Referring to FIG. 9, the embodiment 9 will be explained. Different from the foregoing embodiment 8 wherein the ordinary resin 154 is applied after the conductor 22 is wound around, in the embodiment 9, as shown in FIG. 9(A), the ordinary resin is applied on the core 10 before the conductor 22 is wound around the coil bobbin. Subsequently, as shown in FIG. 9(B), the conductor 22 is wound around over the coating of the ordinary resin 154. This process allows the ordinary resin 154 to impregnate even into the minute cracks between the conductor 22 and the core 10. Afterwards, as shown in FIG. 9(G), the ferrite-mixed resin 156 is applied over the first coating.

The embodiment 9 provides the same effect as the embodiment 8 gives. It also provides advantages, e.g., that there is no direct stress from the conductor 22 on the coil bobbin 16, and that there is no defect, e.g., a break between the adjacent conductors because there are other resins than sheath of wire, e.g., urethane coat, polyester, nylon, or similar material.

(10) Embodiment 10

Referring to FIG. 10, the embodiment 10 will be explained. As shown in FIG. 10 (A), the ordinary resin 154 is applied on the conductor 22 before winding the same around a coil bobbin. This process is implemented, e.g., by dropping the ordinary resin 154 on the conductor along with winding of the conductor around the coil bobbin. After the application of the ordinary resin 154, the conductor 22 is wound around the core 10 as shown in FIG. 10 (B). Accordingly, as in the embodiment 9, this process allows the ordinary resin 154 to impregnate even into the minute cracks between the conductor 22 and the core 10. After the winding process, as shown in FIG. 10 (C), the ferrite-mixed resin 156 is applied over the coated wire. The embodiment 10 provides the same effect as that of the above embodiment 9.

In the foregoing embodiments 8–10, a resin containing a higher proportion of ferrite can be applied as an outer coating after the application of a resin containing a lower proportion of ferrite as a substitute of an ordinary resin. In this case, the inner layer of resin shall have the average ferrite particle size of 5 to 20 $\mu$m range and the filling ratio of 5 to 50 wt % range (a favorable ratio is from 10 to 50 wt % range), and the outer layer of resin shall have the average ferrite particle size of 5 to 20 $\mu$m range and the filling ratio of 30 to 90 wt % range (a favorable ratio is from 60 to 80 wt % range).

(11) Embodiment 11

Figure 11:
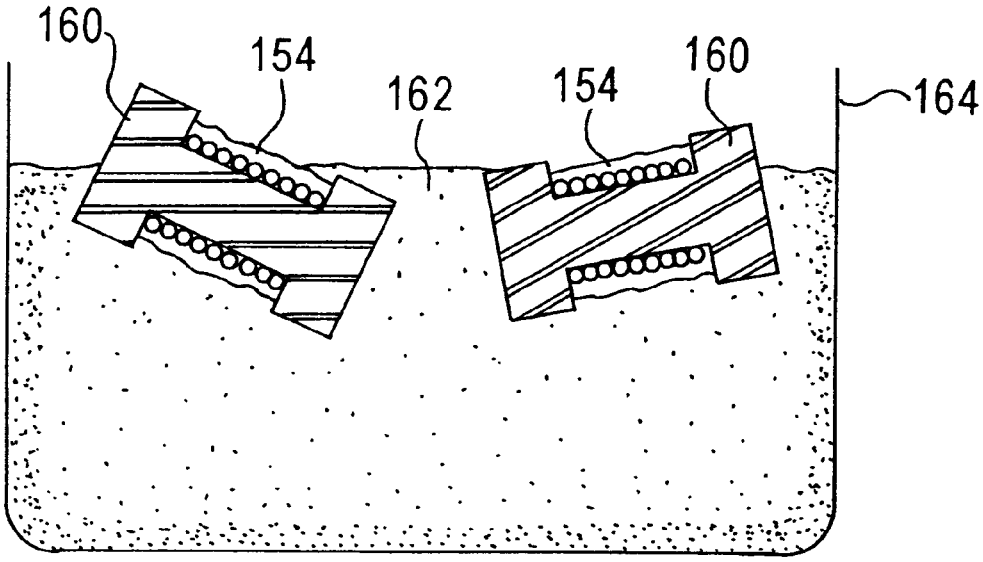
FIG. 11 shows a main manufacturing process of the embodiment 11 of the present invention.

Referring to FIG. 11, the embodiment 11 will be explained. In this embodiment, the devices shown in each of FIGS. 8–10(B), i.e. the devices 160 whereon the ordinary resin 154, i.e., a thermoplastic resin, is applied after winding of the conductor 22 around the core 10, are prepared. The devices 160 are placed into a container 164 along with magnetic powder 162, then heat and vibration are applied. Magnetic materials made of e.g., Mn—Zn or Ni—Zn are used as the magnetic powder 162. The particle size thereof may range, e.g. 0.1 to 100 $\mu$m. One of the application methods of heat and vibration is the application of ultrasonic, i.e., application of heat by a far-infrared lump along with application of ultrasonic vibration. The application of heat and vibration in the above method will allow even adherence of the magnetic powder 162 onto the resin surface of the device 160 by adhesive effect of a thermoplastic resin. The application method will also allow inductance to be stabilized because no external stress is exerted thereon.

(12) Embodiment 12

Figure 12:
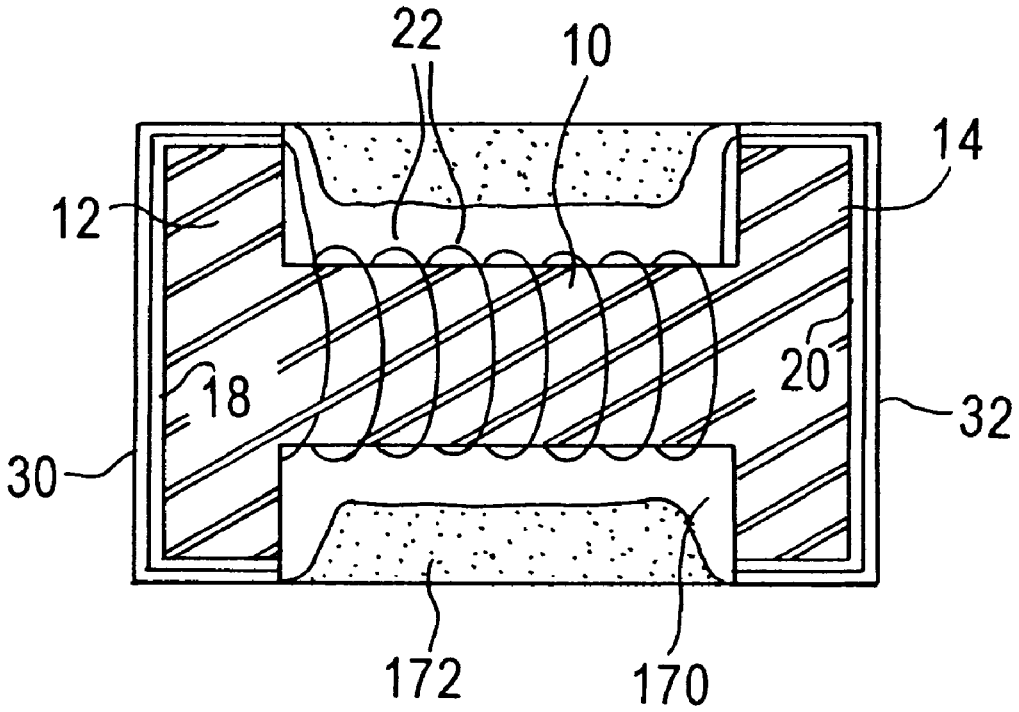
FIG. 12 shows a vertical section of a component provided in the embodiment 12 of the present invention.

Referring to FIG. 12, the embodiment 12 will be explained. In the embodiment 12, an ordinary resin 170 is applied along the surface of the concave portion of the coil bobbin 16, i.e. the core 10 whereon the conductor 22 is wound and the flanges 12 and 14. Subsequently, a ferrite-mixed resin 172 is applied outside of the ordinary resin 170, so that the application of the ferrite-mixed resin 172 caulks the concave portion so as to make the entire surface smooth. In the embodiment 12, the ordinary resin 170 is positioned between the outer ferrite-mixed resin 172 and the line made up of the core 10 and the flanges 12 and 14. Accordingly, the ferrite-mixed resin 172 does not have a direct contact with the core 10 and the flanges 12 and 14, and the ordinary resin 170 act as a buffer, so that the compression stress and the tensile stress exerted on the coil bobbin 16 are relaxed. As described above, also in the embodiment 12, the stresses exerted by the outer sheath is reduced, and the number of cracks generating in the coil bobbin 16 is also reduced.

(13) Embodiment 13

Figure 13:
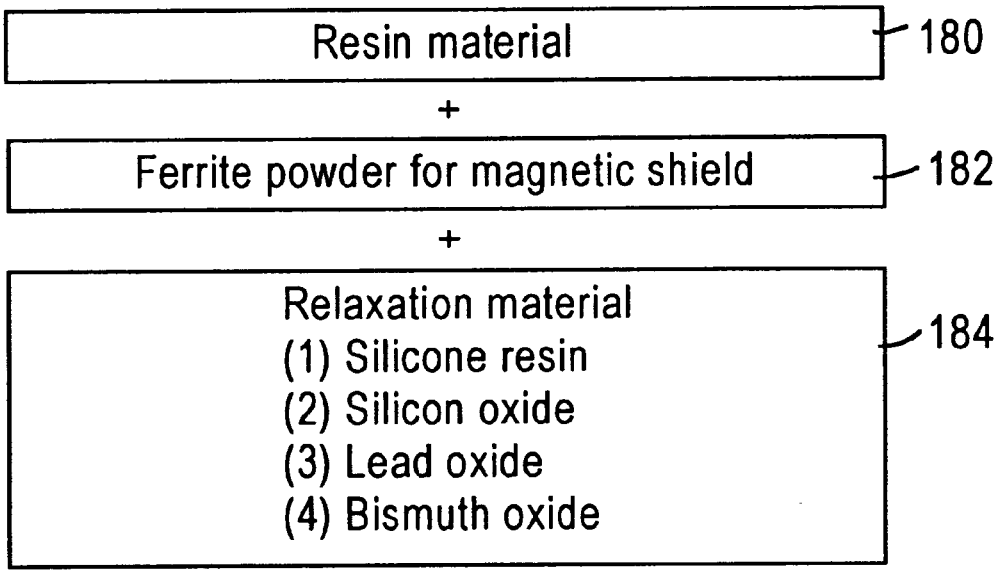
FIG. 13 shows a composition of a sealing resin provided in the embodiment 13 of the present invention.

Referring to FIG. 13, the embodiment 13 will be described. While all of the foregoing embodiments provide the outer sheath part having a two-layer structure, the following embodiments provide the outer sheath part having a one-layer structure. In the embodiment 13, a stress relaxation agent 184 is added as well as a sealing material 180 and ferrite powder for magnetic shielding 182. Specifically, for decreasing the elasticity coefficient, the stress relaxation agent 184 is added to a thermosetting resin, e.g. epoxy resin, phenol resin, copolymer resin or similar resin, wherein ferrite powder is filled. Silicone resin, acrylonitrilebutadiene rubber, silicon oxide, lead oxide (plumbous oxide), bismuth oxide or similar material are used as the stress relaxation agent 184. When powder of silicone resin is used, the average particle size shall range from 1 to 15 $\mu$m, and the mixture ratio thereof shall range from 15 to 30 wt %. Adding silicone resin allows the elasticity coefficient of the entire ferrite-mixed resin to be lowered, thereby the stress exerted on a coil bobbin will be reduced when the resin is hardening.

When using silicon oxide, lead oxide, and bismuth oxide, at least one of them shall be added on the ratio of 1 wt % to the amount weight. Those additives unevenly precipitated among the ferrite powder particles allow stresses to be relaxed.

Although a stress relaxation agent is added to the most outer sheathing resin in the foregoing embodiments, it can also be added to the compound of the coil bobbin or the both of the most outer sheathing resin and the coil bobbin.

(14) Embodiment 14

Next, the embodiment 14 will be explained. In this embodiment, the ferrite powder having a large distribution of particle is used as an additive to the most outer sheathing resin. For example, the ferrite powder having the particle distribution of 5 to 20 $\mu$m range, the smallest size thereof is 1 $\mu$m or smaller, the largest size thereof is 100 $\mu$m or over, is used. In this example, because fine-particles in the ferrite powder move when the resin is hardening, the stress is relaxed. In addition, because the ferrite powder has a good wettability towards the resin material, waterproofness thereof will be improved.

As stated above, the present invention has various unprecedented advantages, as enumerated below:

(1) A high thermal conductive materials are added to a sealing resin. Accordingly, heat radiation and reliability of a wire wound component is improved. Especially when metallic powders are used, inconveniences caused by static electricity is reduced.

(2) Thermal expansion coefficient of a coil bobbin and that of a sealing resin are appropriately adjusted. The coil bobbin can therefore have much closer contact with the sealing resin. By having a multilayer structure in forming a resin layer and surface treatment of the additives placed into the resin to have hydrophobicity and wettability, reliability of the wire wound component is improved in terms of waterproofness and hydrophobicity.

(3) Ferrite powder, main components thereof are $Fe_2O_3$, NiO, ZnO, and CuO, is used as a filler to the sealing resin. Accordingly, temperature in burning the filler can be lowered. Because of the above statement, the size of the ferrite powder particles become more even as well as pulverization of the ferrite powder can be easily implemented, and productivity of the sealing resin is improved because the quality of the sealing resin become more stabilized and wire wound components with even characteristics are easily obtained.

(4) At least one of the below additives, i.e. bismuth oxide ($Bi_2O_3$), silicon oxide ($SiO_2$), and lead oxide ($Pb_3O_4$), is added to a ferrite. Accordingly, characteristic of the ferrite is more stabilized because resistance against stress is improved and variations of magnetic permeability are reduced.

(5) A sealing resin has a multi-layer structure comprising of an ordinary resin and a ferrite-mixed resin, or comprising of a resin containing a lower proportion of ferrite and a resin containing higher proportion of ferrite. Therefore, stress exerted on the sealing resin is desirably relaxed, and a coil bobbin and a conductor can be protected. Variations of inductance caused by changes of stress is also reduced, and wire wound electronic components with even characteristic can be efficiently produced. In addition, reliability of the wire wound electronic component is improved because influence attributed to a pinhole is prevented.

(6) Relaxation materials are added to a sealing material, or ferrite powder with large distribution of particle is filled into the sealing material. Therefore, stresses exerted on the sealing material are also relaxed as in the foregoing cases, and a wire wound electronic component having an excellent reliability which is appropriate for mass production can be provided.

Various modifications will become possible for those skilled in the art after receiving the teachings of the present disclosure without departing from the scope thereof.

(1) A structure of a wire wound electronic component shown in FIG. 5 is just a specific configuration. The present invention is similarly applicable to wire wound electronic components having various structures. For example, the present invention is similarly applicable to a wire wound component with a vertical structure as disclosed in Japanese Patent Laid-Open Publication No. 4-338613. The present invention is also applicable to a wire wound component such as a common mode choke coil, the core thereof is wound with a wire by bifilar winding, or similar wire wound electronic component.

(2) Materials and conditions stated above are also just specific examples and are not restrictive. Combinations of the above stated embodiments are also applicable to a wire wound electronic component.

(3) Inorganic fillers can be added to a ferrite. For example, at least one of the additives below, i.e. $SiO_2$, $Al_2O_3$, and AlN, can be added to the ferrite. These additives can provide the advantages below, i.e. reduction of internal stresses inside a sealing resin, improvement of heat radiation, improvement of mechanical strength or similar advantage, and are favorable for stabilization of characteristic of an inductor device. in addition, mixture of $MnO_2$ in the process of manufacturing a ferrite can improve the magnetic permeability, and mixture of CoO can control thermal characteristics and loss Q (quality factor) of the inductor device.

What is claimed is:

1. A wire wound electronic component, comprising:

a bobbin comprising a core with two ends, having a flange at each end, the flanges defining a recess between them;

a coil of wire wound around the core between the flanges;

a resin seal surrounding the coil between the flanges, said resin seal comprising:

a first layer containing a first proportion of ferrite, and a second layer containing a second proportion of ferrite that is higher than said first proportion of ferrite, and powder of higher thermal conductivity than the resin;

wherein the powder comprises ferrite, and the coefficient of thermal expansion of the resin seal is similar to that of the bobbin.

* * * * *